United States Patent [19]

Ellis

[11] Patent Number: 4,818,742

[45] Date of Patent: Apr. 4, 1989

[54] HEAT SENSITIVE RECORDING ELEMENT

[75] Inventor: Ernest W. Ellis, Carlisle, Mass.

[73] Assignee: Polaroid Corporation, Cambridge, Mass.

[21] Appl. No.: 192,125

[22] Filed: Sep. 28, 1987

[51] Int. Cl.[4] ..... B41M 5/18

[52] U.S. Cl. ..... 503/201; 427/151; 428/195; 428/913; 428/914; 503/223; 503/224; 503/218

[58] Field of Search ..... 427/151, 150, 152; 503/218, 220, 223, 224, 201, 221; 428/195, 913, 914

[56] References Cited

U.S. PATENT DOCUMENTS

| | | | |
|---|---|---|---|
| Re. 29,168 | 4/1977 | Jenkins et al. | 430/522 |
| 3,488,705 | 1/1970 | Fox et al. | 430/53 |
| 3,832,212 | 8/1974 | Jenkins et al. | 430/495 |
| 4,132,436 | 1/1979 | Ishige et al. | 503/218 |
| 4,380,629 | 4/1983 | Yamashita et al. | 430/495 |
| 4,525,588 | 1/1985 | Zink | 503/223 |
| 4,536,219 | 8/1985 | Riou et al. | 503/218 |
| 4,602,263 | 6/1986 | Borror et al. | 503/201 |

OTHER PUBLICATIONS

Kosar, J., Light-Sensitive Systems: Chemistry and Application of Nonsilver Halide Photographic Processes, New York, NY, John Wiley and Sons, Inc., 1976, pp. 402–419.

*Primary Examiner*—Bruce H. Hess
*Attorney, Agent, or Firm*—Sybil A. Campbell

[57] ABSTRACT

A heat responsive recording element having a recording layer containing a colorless di- or tri- aryl compound having a closed ring moiety incorporating the meso carbon atom and containing a nitrogen atom directly bonded to the meso carbon. The nitrogen atom is also bonded to an arylating group that has a displaceable entity. Upon heating the recording layer imagewise the arylating group effects intramolecular arylation of the nitrogen atom with irreversible breaking of the meso carbon atom-nitrogen atom bond rendering the compound colored in the imagewise heating pattern.

4 Claims, No Drawings

HEAT SENSITIVE RECORDING ELEMENT

This invention relates to heat-sensitive recording elements useful for making color images and to a method of imaging using said elements.

DESCRIPTION OF THE PRIOR ART

A variety of thermal imaging systems for producing color images have been proposed. Several have been mentioned in Kosar, J., *Light-Sensitive Systems: Chemistry and Application of Nonsilver Halide Photographic Processes,* New York, John Wiley and Sons, Inc., 1965, pp 402–19. In one type of heat sensitive recording system a first sheet containing a first reagent is superposed with a second sheet containing a second reagent and one of the reagents is melted or vaporized by the imagewise application of heat and transferred for reaction with the other reagent to form a color image. In another type of transferring system, images are formed by sequentially transferring two or more dyes carried on separate donor sheets to a common receptor sheet by melting or volatilization. In thermal imaging systems of the non-transferring type, a single sheet is used and the imagewise heating of the heat sensitive sheet produces a color image, for example, by rendering a coating layer transparent to reveal the color of a background layer, by initiating the chemical reaction of two or more reagents to form a colored product by bleaching, coloring or changing the color of a single reagent.

A number of compounds of the latter type, that is, single compounds which undergo a color change upon application of heat have been disclosed. U.S. Pat. No. 3,488,705 discloses thermally unstable organic acid salts of triarylmethane dyes useful in electrophotographic elements as sensitizing dyes that are decomposed and bleached upon heating. U.S. Pat. No. 3,745,009 reissued as Re. No. 29,168 and U.S. Pat. No. 3,832,212 disclose heat-sensitive compounds for thermography containing a heterocyclic nitrogen atom substituted with an —OR group, for example, a carbonate group that decolorizes by undergoing homolytic or heterolytic cleavage of the nitrogen-oxygen bond upon heating to produce an RO+ ion or RO′ radical and a dye base or dye radical which may in part fragment further. U.S. Pat. No. 4,380,629 discloses styryl-like compounds which undergo coloration or bleaching, reversibly or irreversibly via ring-opening and ring-closing in response to activating energies such as light, heat, and electric potential, U.S. Pat. No. 4,602,263 of Alan L. Borror, Ernest W. Ellis and Donald A. McGowan discloses organic compounds that undergo color formation or color bleaching by an irreversible unimolecular fragmentation of at least one thermally unstable carbamate moiety. U.S. patent application Ser. No. 861,377 of Alan L. Borror and Ernest W. Ellis filed May 14, 1986, discloses di- and triarylmethane compounds possessing within its di- or triarylmethane structure an aryl group substituted in the ortho position to the meso carbon atom with a moiety ring-closed on the meso carbon atom directly through a nitrogen atom, which nitrogen atom is also bound to a group with a masked acyl substituent that undergoes fragmentation upon heating to liberate the acyl group for effecting intramolecular acylation of said nitrogen atom to form a new group in the ortho position whereby the di- or triarylmethane compound is rendered colored.

SUMMARY OF THE INVENTION

The present invention is concerned with thermal imaging systems employing certain di- and triarylmethane compounds comprising a moiety ring-closed on the meso carbon atom, i.e., the methane carbon atom, that are substantially colorless initially and become colored as a result of a thermal reaction which effects an intramolecular reaction whereby the di- or triarylmethane compound becomes irreversibly ring-opened. In the initial compound, the ring-closed moiety is bonded to the meso carbon atom directly through a nitrogen atom and upon heating undergoes intramolecular arylation on said nitrogen atom whereby a new moiety is formed which cannot bond to the meso carbon atom and which irreversibly "traps" the di- or triarylmethane compound in an open, colored form.

Because the subject compounds undergo an intramolecular reaction to effect a color change, coloration can be achieved without the need to transfer a reagent or to contact two reagents, and because coloration can be achieved at moderately elevated temperatures, any conventional heating means for effecting imagewise heating can be employed. Also, di- and triarylmethane compounds useful in the subject thermal imaging systems can be selected to provide a wide range of colors including black as may be desired not only in the production of monochromes and bichromes but in the production of full color images as well.

It is an object of the present invention to provide heat-sensitive recording elements and a method of imaging based thereon.

DESCRIPTION

In accordance with the present invention, a method of thermal imaging is provided which comprises heating imagewise a heat-sensitive element comprising a support carrying at least one layer containing a colorless di- or triarylmethane compound possessing within its di- or triarylmethane structure a moiety ring-closed on the meso carbon atom to form a 5- or 6-membered ring. The ring moiety comprises a carbonyl, sulfinyl, sulfonyl or a substituted or unsubstituted alkylene group and a nitrogen atom bonded directly to the meso carbon atom. The nitrogen atom is also bound, preferably, via a spacing group, an arylating group having a displaceable entity. The arylating group effects intramolecular arylation of the nitrogen atom with breaking of the meso carbon atom-nitrogen atom bond to form a new group that cannot bond to the meso carbon atom. Thus the above referred to ring moiety of the arylmethane compound is opened and the compound is rendered colored in said layer in an imagewise pattern corresponding to said imagewise heating.

As is well known, for these arylmethanes, when the nitrogen atom is bonded to the meso carbon atom the compounds are colorless and when the bond is broken they become colored. In the present invention, substituent groups are incorporated into the molecule to control the electronic "balance" between the colorless and colored forms and thus the efficacy of the reaction. This balancing is done to control in a thermal way the bond between the nitrogen and meso carbon atoms. When this bond is broken the molecule is then "trapped" in the open position by the intramolecular arylation so that the nitrogen-meso carbon atom bond cannot be restored.

In brief compass, the present invention is a heat sensitive recording medium containing in a recording layer a polyaryl methane compound which when heat activated undergoes irreversible intramolecular arylation with visible color change. The compound has the formula (Formula A) and upon heating to a temperature above 100° C. converts to a product having the formula shown:

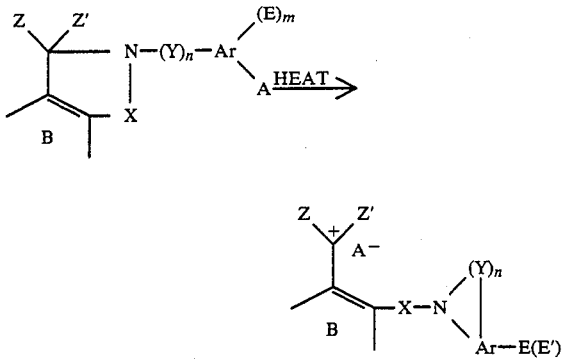

wherein:

Ar, A and (E) are, preferably:

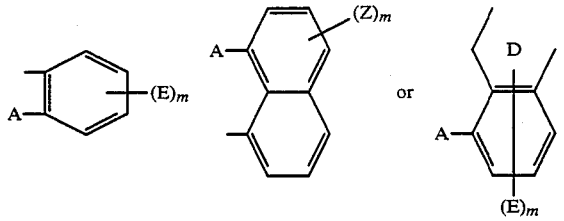

n is 0 or 1, usually 1;

m is 1, 2, 3, 4 or 5;

Ar is an aromatic carbocyclic or heterocyclic ring(s) or fused ring system A is a displaceable group such as halogen preferably flourine), an aromatic oxide, e.g. substituted or unsubstituted phenoxyl or trifluoromethyl sulfonate;

E is an electron withdrawing group or groups to activate A, such as nitro, cyano, methylsulfonyl, and fluoro, or a group that undergoes fragmentation upon heating to liberate a group that renders the intramolecular arylation more efficient, i.e.

$$E \xrightarrow[\Delta]{} E' \text{ e.g.}$$

wherein E' is more electron withdrawing than E;

Y is carbonyl, sulfonyl, sulfinyl, substituted or unsubstituted methylene or ethylene, and —$CH_2CO$—, —$CH_2SO_2$— and —$CH_2SO$—, the methylene group of which can be attached to N or Ar;

X is carbonyl, sulfonyl, methylene or a substituted or unsubstituted ethylene radical, provided that when X is methylene Y, if present, is not an alkylene group;

Z and Z' taken individually are moieties to complete the auxochromophoric system of a di- or triarylmethane dye when the nitrogen is not attached to the meso carbon and when taken together represent bridged moieties to complete the auxochromophoric system of a bridged triarylmethane dye when the nitrogen is not attached to the meso carbon, provided that if Z or Z' have a nitrogen atom in the auxochromic portion, the Y must be methylene, —$CH_2CO$, —$CH_2SO_2$ and —$CH_2SO$ with methylene attached to N or be absent with N and Ar being directly bonded. Usually, at least one of Z and Z' whether taken individually or together possesses as an auxochromic substituent, a nitrogen, oxygen, or sulfur atom or a group of atoms containing nitrogen, oxygen or sulfur;

B is substituted or unsubstituted carbocyclic ring or rings, a heterocyclic ring, or a fused ring system; and D is a substituted or unsubstituted carbocyclic or heterocyclic ring.

In the triarylmethane compounds represented in Formula A, the aryl moieties Z and Z', when taken individually, can be the same or different and typically represent heterocyclic aryl groups containing nitrogen, oxygen or sulfur as the heterocyclic atom, particularly N-heterocyclic aryl groups such as julolidin-3-yl, indol-3-yl, pyrr-2-yl, carbazol-3-yl, and indolin-5-yl wherein the N atom of the indolyl, pyrryl, carbazolyl and indolinyl groups may be substituted with hydrogen or alkyl having 1 to 6 carbon atoms, or the aryl moieties Z and Z' typically may be carbocyclic aryl, particularly phenyl or naphthyl groups which include an appropriately positioned auxochromic substituent, i.e., an atom or group that produces an auxochromic effect, which substituent is usually positioned para to the meso carbon atom. Typically, Z and Z' when taken together represent aryl groups bridged by a heteroatom, such as, oxygen, sulfur or nitrogen to form, for example, 4H-chromeno[2,3-C]pyrazole and particularly represent carbocyclic aryl groups, such as, phenyl groups bridged with a heteroatom, preferably oxygen, sulfur or nitrogen and substituted with hydrogen or an alkyl group having 1 to 6 carbon atoms to provide a xanthene, thioxanthene or an acridine dye, which dyes possess an auxochromic substituent(s) para to the meso carbon atom, i.e., in the 3-position or in the 3,6-positions or meta and para to the meso carbon atom, i.e., in the 3,7-positions.

In the diarylmethane compounds, one of Z and Z' may be heterocyclic aryl or carbocyclic aryl as discussed above and the other of Z and Z' may be, for example, phenoxy, thiophenoxy, alkoxy containing 1 to 20 carbon atoms, alkylthio containing 1 to 20 carbon atoms, —N,N—(disubstituted) amino wherein each said substituent may be alkyl containing 1 to 20 carbon atoms, carbocyclic aryl containing 6 to 12 carbon atoms, aralkyl containing 7 to 15 carbon atoms particularly phenyl- and naphthyl-substituted alkyl or alkaryl containing 7 to 15 carbon atoms particularly alkyl-substituted phenyl and naphthyl. Representative alkyl groups include methyl, butyl, hexyl and octadecyl and representative aryl groups include phenyl and naphthyl. Representative alkaryl groups include p-octylphenyl, o-methylnaphthyl and p-hexylphenyl, and representative aralkyl groups include phenethyl, benzyl and naphthylmethyl.

Examples of useful auxochromic substituents include-$OR_1$ wherein $R_1$ is hydrogen, alkyl usually having 1 to 6 carbon atoms, aralkyl usually having 7 to 15 carbon atoms, alkaryl usually having 7 to 15 carbon atoms or carbocyclic aryl usually having 6 to 12 carbon atoms; —$SR_2$ wherein $R_2$ has the same meaning given for $R_1$; —$NR_3R_4$ wherein $R_3$ and $R_4$ each represent hydrogen, alkyl usually having 1 to 6 carbon atoms, β-substituted ethyl, cycloalkyl usually having 5 to 7 carbon atoms, aralkyl usually having 7 to 15 carbon atoms, alkaryl usually having 7 to 15 carbon atoms or

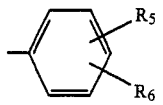

wherein $R_5$ and $R_6$ each are hydrogen, alkyl usually having 1 to 6 carbon atoms, halo such as chloro, bromo, fluoro and iodo, nitro, cyano, alkoxycarbonyl wherein said alkoxy has 1 to 6 carbon atom, sulfonamido (—NH-$SO_2R_0$), sulfamoyl (—$SO_2NHR_0$), sulfonyl (—$SO_2R_0$), acyl (—$COR_0$) or carbamyl (—$CONR_0$) wherein $R_0$ usually is alkyl having 1 to 6 carbon atoms, benzyl or phenyl and $R_3$ and $R_4$ taken together represent the atoms necessary to complete a heterocyclic ring usually piperidino, pyrrolidino, N-methylpiperidino, morpholino or

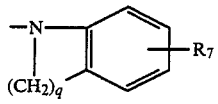

wherein q is an integer 2 to 5 and $R_7$ has the same meaning as $R_5$,

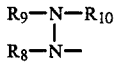

wherein $R_8$ and $R_9$ each are hydrogen, alkyl usually having 1 to 6 carbon atoms or

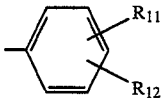

wherein $R_{11}$ and $R_{12}$ have the same meaning as $R_5$ and $R_6$ and $R_{10}$ is —$COR_{13}$, —$CSR_{13}$ or —$SO_2R_{13}$ wherein $R_{13}$ is hydrogen, alkyl usually having 1 to 6 carbon atoms, phenyl, —$NH_2$, —$NHR_{14}$, —$N(R_{14})_2$ or —$OR_{14}$ wherein $R_{14}$ is hydrogen, alkyl usually containing 1 to 6 carbon atoms or phenyl. Representative alkyl groups include methyl, ethyl, propyl, butyl and hexyl. Representative β-substituted ethyl groups include β-methoxymethoxyethyl and β-2′-tetrahydropyranyloxyethyl. Representative aralkyl groups include phenyl and naphthyl-substituted alkyl, such as, benzyl, phenethyl and naphthylmethyl and representative alkaryl groups include alkyl-substituted phenyl and naphthyl, such as, o-methylphenyl, o-methylnaphthyl and p-hexylphenyl. Representative carbocyclic aryl groups include phenyl and naphthyl and representative cycloalkyl groups include cyclopentyl, cycloyhexyl and cycloheptyl. It will be appreciated that the auxochromic substituent(s) will be selected for a given diarylmethane, triarylmethane or bridged triarylmethane compound to provide the desired chromophore color upon opening of the N-containing ring and to achieve facile color formation.

Representative electron-withdrawing groups E in Formula A include cyano, dibenzylsulfonamido, dimethylsulfonamido, methylsulfonyl, phenylsulfonyl, p-tolysulfonyl, carboxy, acetyl, carboethoxy, carbamyl, isothiocyano, benzoyl, trifluoromethyl and halo, e.g., chloro, bromo, fluoro and iodo. Useful electron-donating or electron-neutral groups that undergo fragmentation upon heating to liberate an electron-withdrawing group (E′ in Formula A) include

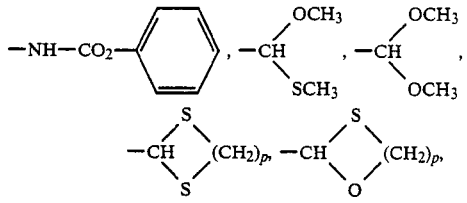

wherein p is an integer 1 to 4,

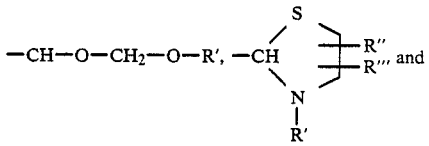

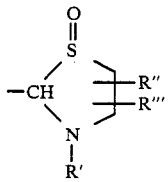

wherein R′ alkyl, usually having 1 to 20 carbon atoms, aryl usually having 6 to 12 carbon atoms, aralkyl usually having 7 to 15 carbon atoms and alkaryl usually having 7 to 15 carbon atoms and R″ and R′R each are hydrogen, alkyl usually having 1 to 6 carbon atoms, aryl having 6 to 12 carbon atoms, and aralkyl and alkaryl usually having 7 to 15 carbon atoms. Typical alkyl, aryl, aralkyl and alkaryl groups for R′, R″ and R‴ are those mentioned above.

As used herein and as well known in the art, an electron-withdrawing group is a group having a positive sigma value. An electron-donating group is a group having a negative sigma value and an electron-neutral group is a group having a sigma value of 0. In addition to the groups specified above, a number of other groups together with their sigma values are listed in Lang's Handbook of Chemistry and in H. H. Jaffe, A Reexamination of the Hammett Equation, *Chem. Reviews,* 1953, pp. 222–23. It will be understood that the electron-donating and the electron-neutral groups selected to provide an electron-withdrawing group will undergo fragmentation under approximately the same heating conditions, i.e., in the same temperature range as required for the reaction that effects the intramolecular alkylation reaction.

Displaceable groups, i.e., A in Formula A, are well known. Various leaving groups have been discussed by Charles J. M. Stirling, *Acc. Chem. Res.* 12, 198 (1979) and Charles J. M. Stirling, et al, *J. Chem. Soc. Chem. Commun.,* 941 (1975). Examples of leaving groups that can be employed besides the halides are imidazolyl; —SMe; —$SO_2Me$; —SPh; —$SO_2Ph$; —SePh; —OPh; —OMe; —P(O)(O Et)$_2$; —$C(Me)_2NO_2$, —N(Me)Ts; —N(Me)$CO_2Ph$; —N(Me)Ac; —N(Ph)Ac; —N(Ph)Ts; and —N(Ph)$CO_2CH_2Ph$; wherein Me, Et, Ph, Ac and Ts represent methyl, ethyl, phenyl, acetyl and tosyl, respectively. The Ps and Ts groups may be substituted with one or more substituents, for example, alkyl, alkoxy, halo, carboxy, nitro, cyano, —$SO_2$alkyl, —$SO_2$ phenyl, tosyl and N,N-(dialkyl)amino.

In addition to the auxochromic substituents, Z and/or Z' and/or the ring B of the ring-closing moiety may possess one or more additional substituents as may be desired that do not interfere with the intended utility for the dye. Typical substituents include carboxy; hydroxy; cyano; thiocyano; mercapto; sulfo; nitro; sulfonamido (—$NHSO_2R_0$); sulfamoyl (—$SO_2NHR_0$); sulfonyl (—$SO_2R_0$); acyl (—$COR_0$); carbamyl (—$CONR_0$); halomethyl such as trifluoromethyl; alkyl usually having 1 to 20 carbon atoms such as methyl, octyl, hexadecyl; alkoxy usually having 1 to 20 carbon atoms such as methoxy, ethoxy, propoxy and butoxy; alkoxycarbonyl having 1 to 6 carbon atoms such as methoxy- and ethoxycarbonyl; aralkyl usually having 7 to 15 carbon atoms, for example, phenyl or naphthyl-substituted alkyl such as benzyl, phenethyl and naphthylmethyl; alkaryl usually having 7 to 15 carbon atoms, for example, alkyl-substituted phenyl or naphthyl such as o-methylphenyl, o-methylnaphthyl and p-hexylphenyl; aralkyloxy usually having 7 to 15 carbon atoms, for example, phenyl or naphthyl-substituted alkoxy, such as benzyloxy, phenethyloxy and naphthylmenthloxy; aryloxy usually containing 6 to 12 carbon atoms such as phenoxy and naphthoxy; thioalkyl groups usually having 1 to 20 carbon atoms such as methylthio, ethylthio and hexylthio; thioaryl and thioaralkyl groups containing up to 15 carbon atoms such as phenylthio, naphthylthio, benzylthio and phenethylthio; halo such as chloro, bromo, fluoro and iodo; amino including mono- and disubstituted amino such as —$NR^8R^9$ wherein $R^8$ and $R^9$ each are hydrogen, alkyl usually having 1 to 20 carbon atoms, aralkyl or alkaryl usually having 7 to 15 carbon toms, and carbocyclic aryl usually having 6 to 12 carbon atoms; and a fused substituent such as a fused benzene ring.

The dye precursor compounds used in the present invention can be monomeric or polymeric compounds. Suitable polymeric compounds are those which, for example, comprise a polymeric backbone chain having dye precursor moieties attached directly thereto or through pendant linking groups. Polymeric compounds of the invention can be provided by attachment of the dye precursor moiety to the polymeric chain via the Z and/or Z' moieties or the ring B. For example, a monomeric dye precursor compound having a reactable substituent group, such as an hydroxyl or amino group, can be conveniently reacted with a mono-ethylenically unsaturated and polymerizable compound having a functional and derivatizable moiety, to provide a polymerizable monomer having a pendant dye precursor moiety. Suitable mono-ethylenically unsaturated compounds for this purpose include acrylyl chloride, methacrylyl chloride, methacrylic anhydride, 2-isocyanatoethyl methacrylate and 2-hydroxyethyl acrylate, which can be reacted with an appropriately substituted dye precursor compound for production of a polymerizable monomer which in turn can be polymerized in known manner to provide a polymer having the dye precursor compound pendant from the backbone chain thereof. In this manner, a dye precursor compound can be reacted with 2-isocyanatoethyl methacrylate for production of the corresponding urethane derivative via reaction of the respective hydroxyl and isocyanate groups. The desired polymer can then be obtained by free-radical initiated addition polymerization, using a free-radical catalyst such as a,a-azodiisobutyronitrile (AIBN) according to known methodology. It will be appreciated, however, that other dye precursor compounds can be attached via other means to other polymerizable compounds for the production of other polymeric compounds having the desired property of forming color discussed above.

The preferred compounds of the present invention are those represented by the Formula A wherein Ar has one of the three ring configurations illustrated and more preferably is a single benzene ring, and wherein Y is carbonyl, methylene or methylene carbonyl; and E and A are halogens and more preferably a fluorine. Ring B is preferably a single benzene which can be substituted with alkyl having 1 to 6 carbon atoms, alkoxy having 1 to 6 carbon atoms, alkoxycarbonyl having 1 to 6 carbon atoms, carboxy, cyano, thiocyano, nitro, sulfo, sulfonamido, sulfamoyl, sulfonyl, acyl, carbamyl, halo, —OR wherein R is hydrogen, alkyl having 1 to 6 carbon atoms, benzyl or phenyl, —$SR^0$ wherein $R^0$ has the same meaning as R or —$NR^5R^6$ wherein $R^5$ and $R^6$ each are hydrogen, alkyl having 1 to 6 carbon atoms, $\beta$-substituted ethyl, benzyl or phenyl. Z and Z', the same or different, are preferably selected from phenyl substituted in the 4-position with —$OR^1$ wherein $R^1$ has the same meaning as R, —$SR^2$ wherein $R^2$ has the same meaning as R or —$NR^5R^6$ wherein $R^5$ and $R^6$ have the same meaning given above and substituted in the 2-, 3-, 5- and 6-positions with hydrogen, alkyl or alkoxy having 1 to 6 carbon atoms, or chloro or substituted in the 5- 6-positions with a fused benzene ring; indol-3-yl substituted in the 1 and 2 positions with hydrogen, alkyl having 1 to 6 carbon atoms, benzyl or phenyl pyrr-2-yl substituted in the 1-position with hydrogen, alkyl having 1 to 6 carbon atoms, benzyl or phenyl; and carbazol-3-yl substituted in the 9-position with hydrogen, alkyl having 1 to 6 carbon atoms, benzyl orphenyl; and Z and Z' taken together represent phenyl groups bridged by a hereroatom selected from oxygen, sulfur and nitrogen substituted with hydrogen or alkyl having 1 to 6 carbon atoms to form xanthene, thioxanthene or acridine (a) substituted in the 3- and 6-positions with a group, the same or different, selected from —$OR^3$ wherein $R^3$ has the same meaning as R, —$SR^4$ wherein $R^4$ has the same meaning as R and —$NR^7R^8$, wherein $R^7$ is hydrogen or alkyl having 1 to 6 carbon atoms and $R^8$ is alkyl having 1 to 6 carbon atoms, benzyl or

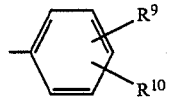

wherein $R^9$ and $R^{10}$ each are hydrogen, alkyl usually having 1 to 6 carbon atoms, alkoxy having 1 to 6 carbon atoms, chloro, nitro, cyano, alkoxycarbonyl wherein said alkoxy has 1 to 6 carbon atoms, sulfonamido, sulfamoyl, sulfonyl, acyl, or carbamyl and $R^9$ and $R^{10}$ taken together represent indolino and

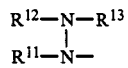

wherein $R^{11}$ and $R^{12}$ each are hydrogen, alkyl having 1 to 6 carbon atoms or

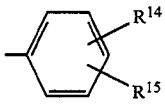

wherein $R^{14}$ and $R^{15}$ have the same meaning as $R^9$ and $R^{10}$ and $R^{13}$ is —$COR^{16}$ wherein $R^{16}$ is hydrogen, alkyl having 1 to 6 carbon atoms or phenyl and substituted in the 1-, 2-, 4-, 5-, 7- and 8-positions with hydrogen, alkyl having 1 to 6 carbon atoms, alkoxy having 1 to 6 carbon atoms or chloro or (b) substituted in the 3-position with —$NR^{17}R^{18}$ wherein $R^{17}$ is hydrogen, alkyl having 1 to 6 carbon atoms, cycloalkyl having 5 to 7 carbon atoms, benzyl or phenyl and $R^{18}$ is alkyl having 1 to 6 carbon atoms, cycloalkyl having 5 to 7 carbon atoms, benzyl or phenyl and $R^{17}$ and $R^{18}$ taken together represent piperidino, pyrrolidino, N-methylpiperidino or indolino and (1) substituted in the 7- and 8-positions with a fused benzene ring or (2) substituted in the 7-position with hydrogen, —$NR^{17}R^{18}$ wherein $R^{17}$ and $R^{18}$ have the same meaning given above, alkyl having 1 to 6 carbon atoms, alkoxy having 1 to 6 carbon atoms or chloro and substituted in the 1-, 2-, 4-, 5-, 6- and 8-positions with hydrogen, alkyl having 1 to 6 carbon atoms, alkoxy having 1 to 6 carbon atoms or chloro.

EXAMPLES

Compound I

To produce Compound I, the following two compounds are reacted.

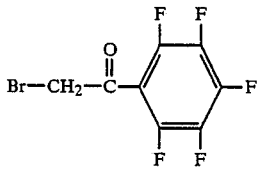

+

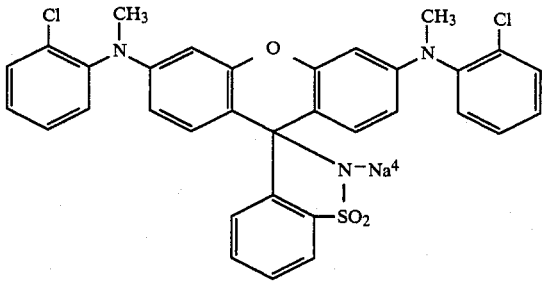

↓

-continued

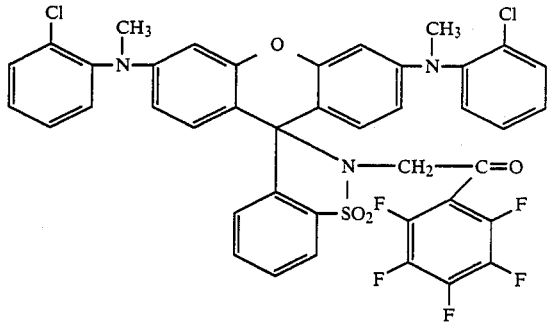

Compound I is colorless. Upon heating to 190 C., it irreversibly converts to the following compound, which produces a strong magenta color.

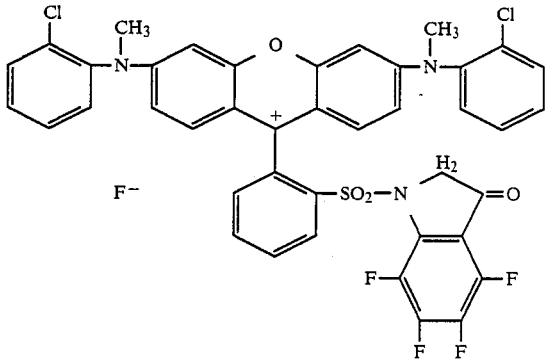

In producing images according to the present invention, the way in which the heat is applied or induced imagewise may be realized in a variety of ways, for example, by direct application of heat using a thermal printing head or thermal recording pen or by conduction from heated image-markings of an original using conventional thermographic copying techniques. Preferably, selective heating is produced in the image-forming layers by the conversion or electromagnetic radiation into heat and preferably, the light source is a laser beam emitting source such as a gas laser or semiconductor laser diode. The use of a laser beam is not only well suited for recording in a scanning mode but by utilizing a highly concentrated beam, photo-energy can be concentrated in a small area so that it is possible to record at high speed and high density. Also, it is a convenient way to record data as a heat pattern in response to transmitted signals such as digitized information and a convenient way of preparing multicolor images by employing a plurality of laser beam sources that emit laser beams of different wavelengths.

In the latter embodiment an infra-red absorbing substance is employed for converting infra-red radiation into heat which is transferred to the colorless di- or triarylmethane compound to initiate the intramolecular alkylation reaction to form color images. Obviously, the infra-red absorber should be in heat-conductive relationship with the heat-sensitive compound, for example, in the same layer as the heat-sensitive compound or in an adjacent layer. Preferably, the infra-red absorber is an organic compound, such as, a cyanine, merocyanine or thiopyrylium dye and preferably, is substantially non-absorbing in the visible region of the electromagnetic spectrum so that it will not add any substantial amount of color to the $D_{min}$ areas, i.e., the highlight areas of the image.

In the production of multicolor images, infra-red absorbers may be selected that absorb radiation at different wavelengths above 700 nm, which wavelengths are at least about 60 nm apart. Thus each imaging layer may be exposed independently of the others by using an appropriate infra-red absorber. As an illustration, the layers of heat-sensitive compound for forming yellow, magenta and cyan may have infra-red absorbers associated therewith that absorb radiation at 760 nm, 820 nm and 1100 nm, respectively, and may be addressed by laser beam sources, for example, infra-red laser diodes emitting laser beams at these respective wavelengths so that the yellow imaging layer can be exposed independently of the magenta and cyan imaging layers, the magenta imaging layer can be exposed independently of the yellow and cyan imaging layers, and the cyan imaging layer can be exposed independently of the yellow and magenta imaging layers. While each layer may be exposed in a separate scan, it is usually preferred to expose all of the imaging layers simultaneously in a single scan using multiple laser beam sources of the appropriate wavelengths. Rather than using superposed imaging layers, the heat-sensitive compounds and associated infra-red absorbers may be arranged in an array of side-by-side dots or strips in a single recording layer.

In a further embodiment, multicolor images may be produced using the same infra-red absorbing compound in association with each of two or more superposed imaging layers and exposing each imaging layer by controlling the depth of focussing of the laser beam. In this embodiment, the concentration of infra-red absorber is adjusted so that each of the infra-red absorbing layers absorb approximately the same amount of laser beam energy. For example, where there are three infra-red absorbing layers, each layer would absorb about one-third of the laser beam energy. It will be appreciated that controlling the focussing depth to address each layer separately may be carried out in combination with the previous embodiment of using infra-red absorbers that selectively absorb at different wavelengths in which instance the concentration of infra-red absorber would not have to be adjusted for the laser beam energy since the first infra-red dye would not absorb any substantial amount of radiation at the absorption peaks of the second and third dyes and so forth.

Where imagewise heating is induced by converting light to heat as in the embodiments described above, the heat-sensitive element may be heated prior to or during imagewise heating. This may be achieved using a heating platen or heated drum or by employing an additional laser beam source for heating the element while it is being exposed imagewise.

The heat-sensitive elements of the present invention comprise a support carrying at least one imaging layer of the above-denoted heat-sensitive compounds and may contain additional layers, for example, a subbing layer to improve adhesion to the support, interlayers for thermally isolating the imaging layers from each other, infra-red absorbing layers as discussed above, anti-static layers, an anti-abrasive topcoat layer which also may function as an UV protecting layer by including an ultraviolet absorber therein or other auxiliary layers. For example, an electroconductive layer may be included and imagewise color formation effected by heat energy generated in response to an electrical signal.

The heat-sensitive compounds are selected to give the desired color or combination of colors, and for multicolor images, the compounds selected may comprise the additive primary colors red, green and blue, the subtractive primaries yellow, magenta and cyan or other combinations of colors, which combinations may additionally include black. As noted previously, the compounds generally are selected to give the subtractive colors cyan, magenta and yellow commonly employed in photographic processes to provide full natural color. Also, a triarylmethane compound that forms a black dye can be selected for providing a black image.

The support employed may be transparent or opaque and may be any material that retains its dimensional stability at the temperature used for image formation. Suitable supports include paper, paper coated with a resin or pigment, such as, calcium carbonate or calcined clay, synthetic papers or plastic films, such as polyethylene, polypropylene, polycarbonate, cellulose acetate, polyethylene terephthalate and polystyrene.

Usually the layer of heat-sensitive compound contains a binder and is formed by combining the heat-sensitive compound and a binder in a common solvent, applying a layer of the coating composition to the support and then drying. Rather than a solution coating, the layer may be applied as a dispersion or an emulsion. The coating composition also may contain dispersing agents, plasticizers, defoaming agents, coating aids and materials such as waxes to prevent sticking where thermal recording heads or thermal pens are used to apply the imagewise pattern of heat. In forming the layer(s) containing the heat-sensitive compounds and the interlayers or other layers, temperatures should be maintained below levels that will initiate the arylation reaction so that the heat-sensitive compounds will not be prematurely colored.

Any of the binders commonly employed in heat-sensitive recording elements may be employed provided that the binder selected is inert, i.e., does not have any adverse effect on the heat-sensitive compound incorporated therein. Also, the binder should be heat-stable at the temperatures encountered during image formation and it should be transparent so that it does not interfere with viewing of the color image. Where electromagnetic radiation is employed to induce imagewise heating, the binder also should transmit the light intended to initiate image formation. Examples of binders that may be used include polyvinyl alcohol, polyvinyl pyrrolidone, methyl cellulose, cellulose acetate butyrate, copolymers of styrene and butadient, polymethyl methacrylate, copolymers of methyl and ethyl acrylate, polyvinyl acetate, polyvinyl chloride, polyvinyl butyral and polycarbonate.

As an illustration of the thermal "coloration" of the compounds of the present invention, Compound I is coated on a white pigmented polyester support by combining the compound and a binder and an infra-red absorber in a solvent, applying a layer of the coating composition to the support using a #16 Meyer Rod and then drying the coating. The formulation used for preparing the coatings is as follows:

10 mgs of Compound I 0.5 ml of 2% polycarbonate in methylene chloride; 0.05% by weight of infra-red absorber having the formula

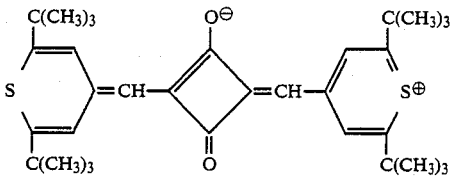

A strip of the coated sample is placed on a hot plate pre-heated to 190° C., and a magenta color develops over time. The Compound becomes fully colorized in about one-half minute.

A sample of the coated material containing Compound I also is irradiated using a laser diode emitting at a wavelength of 824 nm and at an output of 20 m Watts. The coated sample is converted from substantially colorless to magenta in the track of the irradiation.

I claim:

1. A heat sensitive recording medium comprising a support carrying a recording layer, said recording layer containing a compound which when heat activated undergoes irreversible intramolecular arylation of the nitrogen atom and visible color change, said compound having the formula:

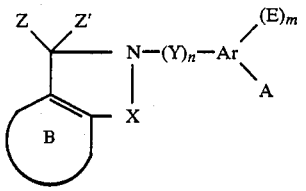

wherein:

n is 0 or 1;

m is 1, 2, 3, 4 or 5;

Ar is an aromatic carbocyclic or heterocyclic ring(s) or fused ring system;

A is a displaceable group;

E is an electron withdrawing group or groups activating A;

Y is carbonyl, sulfonyl, sulfinyl, substituted or unsubstituted methylene or ethylene, and —$CH_2CO$—, —$CH_2SO_2$— and —$CH_2SO$—, the methylene group of which can be attached to N or Ar;

X is carbonyl, sulfonyl, methylene or a substituted or unsubstituted ethylene radical, provided that when X is methylene, Y, is present, is not an alkylene group;

Z and Z' taken individually are moieties completing the auxochromophoric system of a di- or triarylmethane dye when the nitrogen is not attached to the meso carbon and when taken together represent bridged moieties to complete the auxochromophoric system of a bridge triarylmethane dye when the nitrogen is not attached to the meso carbon, provided that if Z or Z' have a nitrogen atom in the auxochromic portion, then Y must be methylene —$CH_2CO$—, —$CH_2SO_2$— or —$CH_2SO$— with said methylene attached to N or be absent with N and Ar being directly bonded; and B is substituted or unsubstituted carbocyclic ring or rings, a heterocyclic ring, or a fused ring system.

2. The recording medium of claim 1 wherein n is 1 and Ar, A and (E) are selected from the group consisting of

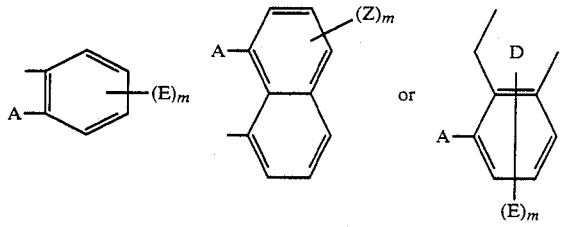

wherein D is a substituted or unsubstituted carbocyclic or heterocyclic ring.

3. The recording medium of claim 1 wherein said compound upon heating to a temperature above 100° C. converts to a compound having the formula:

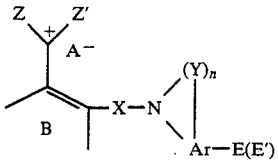

4. A thermal imaging method which comprises heating imagewise a heat sensitive element comprising a support carrying at least one passing layer containing an organic compound which when heat activated undergoes irreversible intramolecular arylation of the nitrogen atom and a visible color change, said compound having the formula:

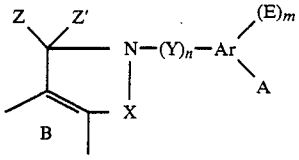

wherein:

n is 0 or 1;

m is 1, 2, 3, 4 or 5;

Ar is an aromatic carbocyclic or heterocyclic ring(s) or fused ring system;

A is a displaceable group

E is an electron withdrawing group or groups activating A;

Y is carbonyl, sulfonyl, sulfinyl, substituted or unsubstituted methylene or ethylene, and —$CH_2CO$—, —$CH_2SO_2$— and —$CH_2SO$—, the methylene group of which can be attached to N or Ar;

X is carbonyl, sulfonyl, methylene or a substituted or unsubstituted ethylene radical, provided that when X is methylene, Y if present is not an alylene group;

Z and Z' taken individually are moieties completing the auxochromophoric system of a di-or triarylmethane dye when the nitrogen is not attached to the meso carbon and when taken together represent bridged moieties to complete the auxochromophoric system of a bridge triarylmethane dye when the nitrogen is not attached to the meso carbon, provided that if Z or Z' have a nitrogen atom in the auxochromic portion, then Y must be methylene —$CH_2CO$—, —$CH_2SO$— or —$CH_2SO$— with said methylene attached to N or be absent with N and Ar being directly bonded; and B is substituted or unsubstituted carbocyclic ring or rings, a heterocyclic ring, or a fused ring system.

* * * * *